United States Patent [19]

Jones

[11] Patent Number: 4,873,523

[45] Date of Patent: Oct. 10, 1989

[54] SHALLOW WATER INDICATOR FOR A BOAT

[76] Inventor: Harry E. Jones, 9408 NE. 188th St., Bothell, Wash. 98011

[21] Appl. No.: 106,723

[22] Filed: Oct. 8, 1987

[51] Int. Cl.[4] ..... G08B 23/00

[52] U.S. Cl. ..... 340/984; 116/113; 200/61.18; 200/61.42

[58] Field of Search ..... 340/984, 985; 116/26, 116/107, 113, DIG. 34; 73/184, 181, 170 A; 200/79, 61.13, DIG. 26, 85 R, 61.14, 61.18, 61.42, 61.43, 61.44, 61.52, 183, 61.77, 61.83, 153 A, 153 T

[56] References Cited

U.S. PATENT DOCUMENTS

| | | | |
|---|---|---|---|
| 358,655 | 3/1887 | Frik | 116/113 |
| 561,982 | 6/1896 | Franklin | 200/85 R |
| 575,093 | 1/1897 | Babcock | 340/984 |
| 608,104 | 7/1898 | Buckley | 200/85 R |
| 720,015 | 2/1903 | Forster | 116/113 |
| 751,623 | 2/1904 | Farr | 73/184 |
| 871,556 | 11/1907 | Bangs | 116/113 |
| 1,181,251 | 3/1916 | Repshold | 116/113 |
| 2,369,054 | 2/1945 | Kehrer | 177/311 |
| 2,490,217 | 12/1949 | Keating | 200/52 |
| 2,507,986 | 5/1950 | Liss | 200/52 |
| 2,975,397 | 3/1961 | Edgerton | 200/61.42 |
| 3,339,407 | 9/1967 | Campbell et al. | 73/170 A |
| 3,418,627 | 12/1968 | Lyons | 200/61.18 |
| 3,433,442 | 3/1969 | Durocher et al. | 200/61.42 |
| 3,859,490 | 1/1975 | Fohey | 200/223 |

FOREIGN PATENT DOCUMENTS

| | | | |
|---|---|---|---|
| 2312604 | 1/1977 | France | 200/61.42 |

*Primary Examiner*—Joseph A. Orsino
*Assistant Examiner*—Jill D. Jackson
*Attorney, Agent, or Firm*—Delbert J. Barnard; Glenn D. Bellamy

[57] ABSTRACT

Disclosed is a shallow water detector (10) for a boat (12) comprising a main housing (16) positionable on the boat (12), a source of electrical energy (102), a signal device (36, 38), and an actuating switch assembly (108). The actuating switch assembly includes a normally off, snap-action microswitch (110) enclosed in a housing and having a depressible operator (112) projecting therefrom which, when depressed, turns the microswitch (110) on. A switch actuator member (30) has an end portion (114) directed toward the depressible operator (112) and a guide means (116) which guides the actuator member (30) towards and away from the depressible operator (112). The actuator member (30) is biased by a spring means (120) toward and into depressing contact with the depressible operator (112). A line (28)is connected at one end to the actuator member (30) and at the other end to a weight (32). The signal device (36, 38), the source of electrical energy (102), and the microswitch (110) are connected by a conductor means (132) such that when the contacts of the microswitch (110) are closed, the signal device (36, 38) is powered by the source of electrical energy (102). The weight (32), when free-hanging, moves the actuator member (30) away from depressing contact with the depressible operator (30), causing the contacts of the microswitch (110) to open. When the weight (32) becomes grounded on the bottom (34) of a body of shallow water (14'), the line 28 becomes slack and the actuator member (30) is moved into depressing contact with the depressible operator (112) of the microswitch (110), closing its contacts and, thereby, causing the signal device (36, 38) to operate.

16 Claims, 7 Drawing Sheets

SHALLOW WATER INDICATOR FOR A BOAT

TECHNICAL FIELD

This invention relates to warning devices, and more particularly to devices for warning of shallow water beneath boats.

Background Art

When a boat is anchored or moored, a receding tide could create a danger of the water becoming too shallow, resulting in a grounding of the boat. Grounding of the boat could result in damage to its hull or keel and, perhaps, injury to persons on board.

It is known in the art to use a warning device to alert the boat operator of this dangerous condition. A typical shallow water detection system uses a detector depending from the boat into the water which is connected to a signal device. Such a system may use a mercury switch at the lower end of a cable, such as those described in U.S. Pat. Nos. 3,859,490 and 2,507,986, or a bottom contact activated switch, such as those described in U.S. Pat. Nos. 751,623 or 575,093, to activate a signal device. These types of triggering means require running at least a two conductor cable through the water between the signal device onboard and the submerged switch. The cable and switch casing must remain absolutely water tight to prevent short circuiting.

Another approach, described in U.S. Pat. No. 2,369,054, uses a weight to deflect a beam for, in that manner, holding open electrical contacts This device maintains all electrical circuits above the waterline but, like all such devices using direct action contacts, is subject to excessive corrosion and arcing of the contacts A principal object of the present invention is to provide a device for detecting and warning of dangerously shallow water beneath a boat which is simple and compact, but yet is very reliable and effective.

DISCLOSURE OF THE INVENTION

Provided is a shallow water detector for a boat that will alert the boat operator of a potentially dangerous shallow water condition beneath the boat. Positioned on the boat is a main housing, a signaling device, and a source of electrical current. Within the main housing is a normally open, snap-action microswitch enclosed in a switch housing and having an outwardly projecting depressible operator, which when depressed closes the switch contacts. An electrical conductor means connects the source of electrical current with the microswitch and the signal device such that when the microswitch contacts are closed the signal device operates.

A switch actuator member is guided to move towards and away from the depressible operator of the microswitch. The actuator member is spring biased into depressing contact with the depressible operator. A line is attached at one end to the actuator member and at the other end to a weight having a mass great enough that, when suspended, the force of the spring is overcome, the actuator member is pulled away from depressing contact with the depressible operator, and the switch contacts are opened.

The line is of a predetermined length such that the weight, when depending into the water, remains suspended by the line so long as the water beneath the boat is of a safe depth. If the water beneath the boat becomes dangerously shallow, the weight will become grounded, the line will become slack allowing the actuator member to depress the depressible operator and, thereby, close the contacts of the microswitch. When the microswitch contacts close, the electrical current is connected to the signal device, causing the signal device to operate and alert the boat operator of a shallow water condition. "Dangerously shallow" is used herein to mean a shallow depth prior to but approaching a grounding depth.

These and other aspects, features, characteristics and advantages pertaining to and inherent in the present invention will be apparent from the following description and accompanying drawings of a preferred but nonlimitive embodiment of the invention.

BRIEF DESCRIPTION OF THE DRAWING

Referring to the several figures of the drawing, wherein like numerals refer to like parts throughout, and wherein.

BEST MODE FOR CARRYING OUT THE INVENTION

Figure 1:
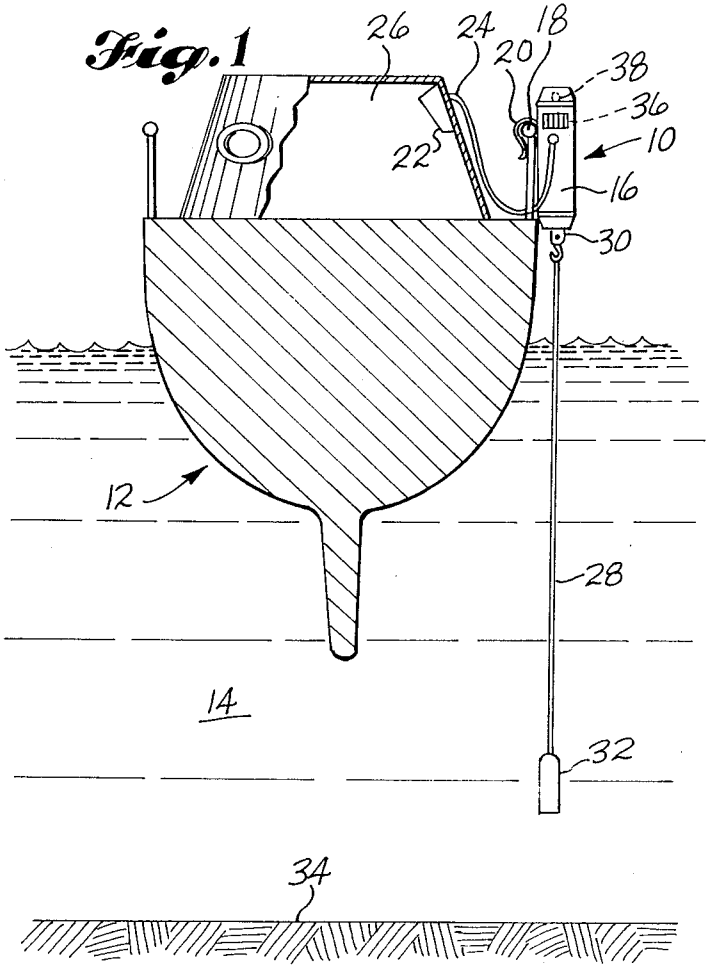
FIG. 1 is a view of an embodiment of the invention in use on a boat in water of safe depth.

Referring now to the drawings, and first to FIG. 1, therein is shown an embodiment of my shallow water detector device 10 attached to a boat 12 floating in a body of water 14 of safe depth. The main housing 16 of the device 10 is shown attached to a rail 18 on the boat 12 by means of a clip 20. Depicted is an embodiment of the invention having a remote signal device 22 which may be connected to the detector 10 by means of an extension cable 24. The remote signal means 22 is shown installed in an interior cabin portion 26 of the boat 12. Depending into the water 14 from the main housing 16 is a line 28 attached at one end to the switch actuator member 30 and at the other end to a weight 32.

Figure 2:
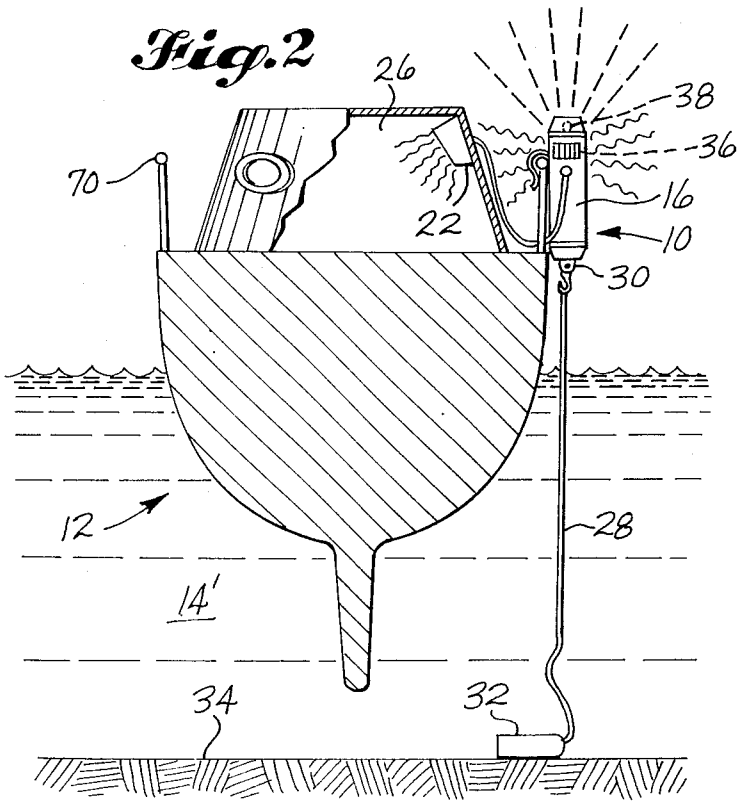
FIG. 2 is a view of the embodiment of the invention in use on a boat in water of dangerously shallow depth.

FIG. 2 shows the boat 12 in dangerously shallow water 14'. The weight 32 has become grounded on the bottom surface 34 of the shallow body of water 14' and the line 28 has become slack. FIG. 2 illustrates the signal devices, a buzzer 36, a light 38, and the remote signal 22, in operation. Any conspicuous, electrically operated or activated sound or light emitting device may be used as the signal device.

Figure 3:
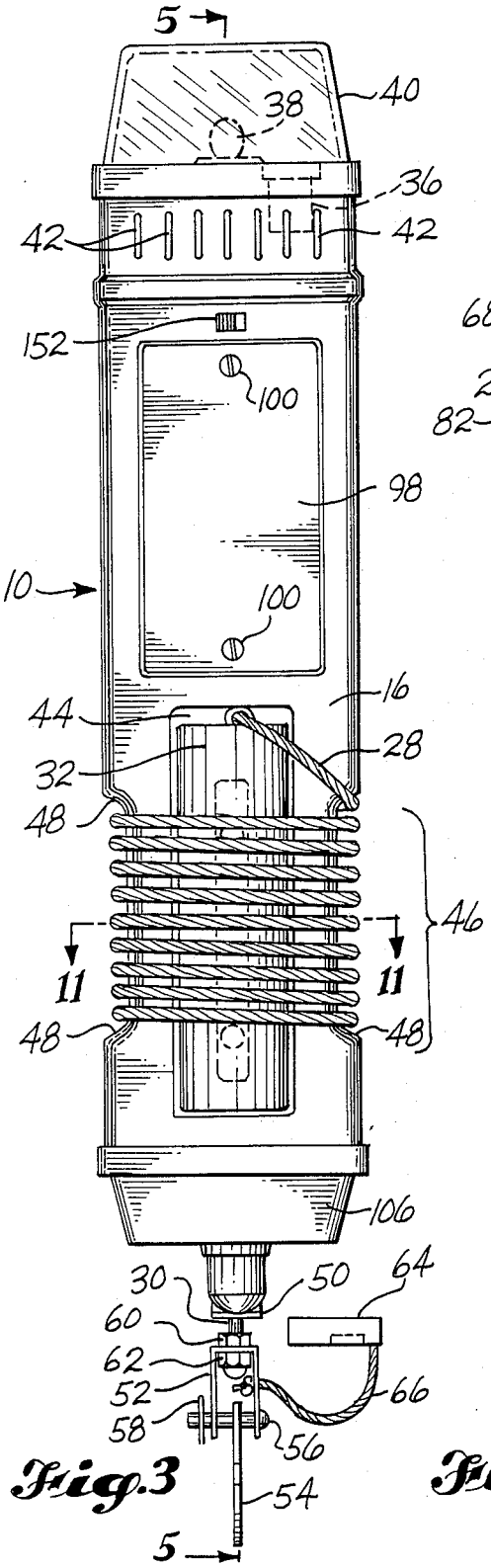
FIG. 3 is a front elevation of an embodiment of the invention showing, the weight and line in a stowed position.

FIG. 3 shows a front plan view of a preferred embodiment of the shallow water detector 10. At the top of the main housing 16 is mounted a signal light 38 which is protected by a transparent or other type plastic lens cap 40. A warning buzzer 36 is mounted within the main housing 16 which has a plurality of openings 42 formed therein adjacent to the signal buzzer 36. These openings 42 allow the sound of the signal buzzer 36 to emit from within the main housing 16. A cavity 44 is formed within the main housing 16 and is shaped to receive the weight 32 when the device is not in use. In the main housing 16 adjacent to the cavity 44 is formed narrowed portions 46 which are defined by shoulder regions 48. The line 28 may be wrapped around the main housing 16 at the narrowed regions 46 when the detector 10 is not in use. The line 28 is shown by broken lines wrapped around the narrowed portion 46 of the main housing 16. A flexible rope made of a durable material, such as nylon, is preferred. The line 28 wrapped in this fashion may serve to capture the weight 32 within the cavity 44, holding it secure when the detector 10 is not in use.

Extending through the lower end of the main housing 16 is an actuator member 30. Immediately adjacent thereto is a rigid support member 50, shown in FIGS. 4 and 5 extending from the lower end of the main housing 16 and across its lower portion in a supporting manner. Function and structure of the rigid support member 50 will be discussed in greater detail below. Attached to the actuator member 30 is a clevis 52 and hook 54 which provide a pivoting attachment for the line 28 to the actuator member 30. The hook 54 is attached to the clevis 52 by a pin 56 and key 58. The clevis 52 is attached to a threaded portion 31 of the actuator member 30 and bound between upper and lower threaded clevis nuts 60, 62. An actuator stop member or hold-open insert 64 may be inserted around the actuator member 30 between the support member 50 and the upper clevis nut 60 to prohibit activation of the device when the detector is not in use. The function of the actuator stop member 64 will be explained in greater detail below. The actuator stop member 64 may be attached to the clevis 52 by a retaining laniard 66.

Figure 4:
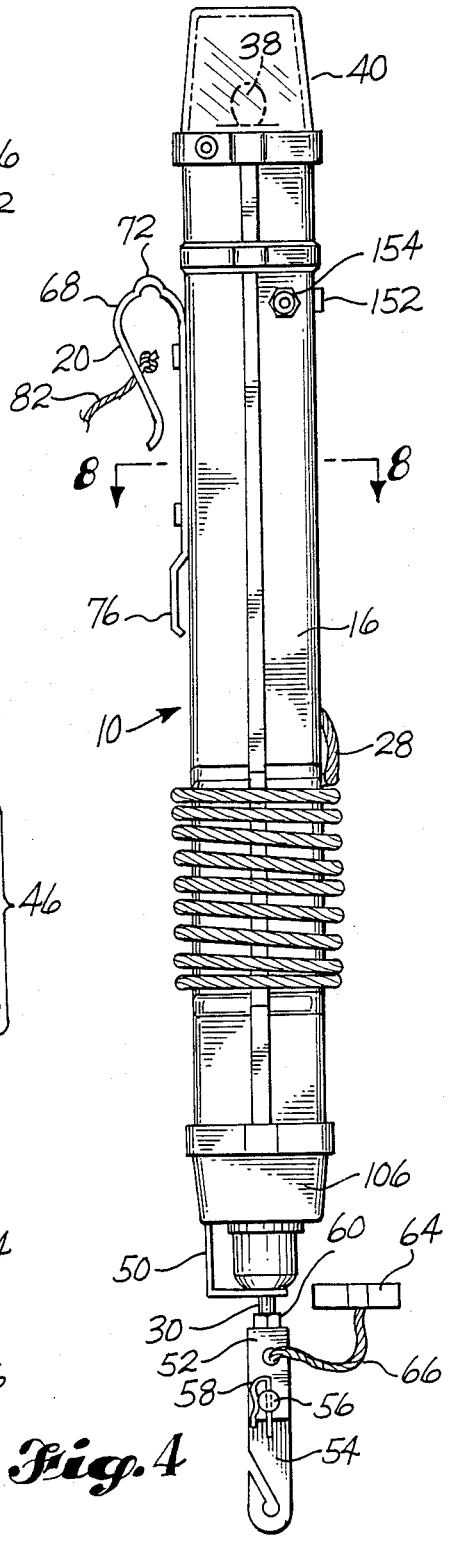
FIG. 4 is a side elevation of the embodiment of FIG. 3.
Figure 5:
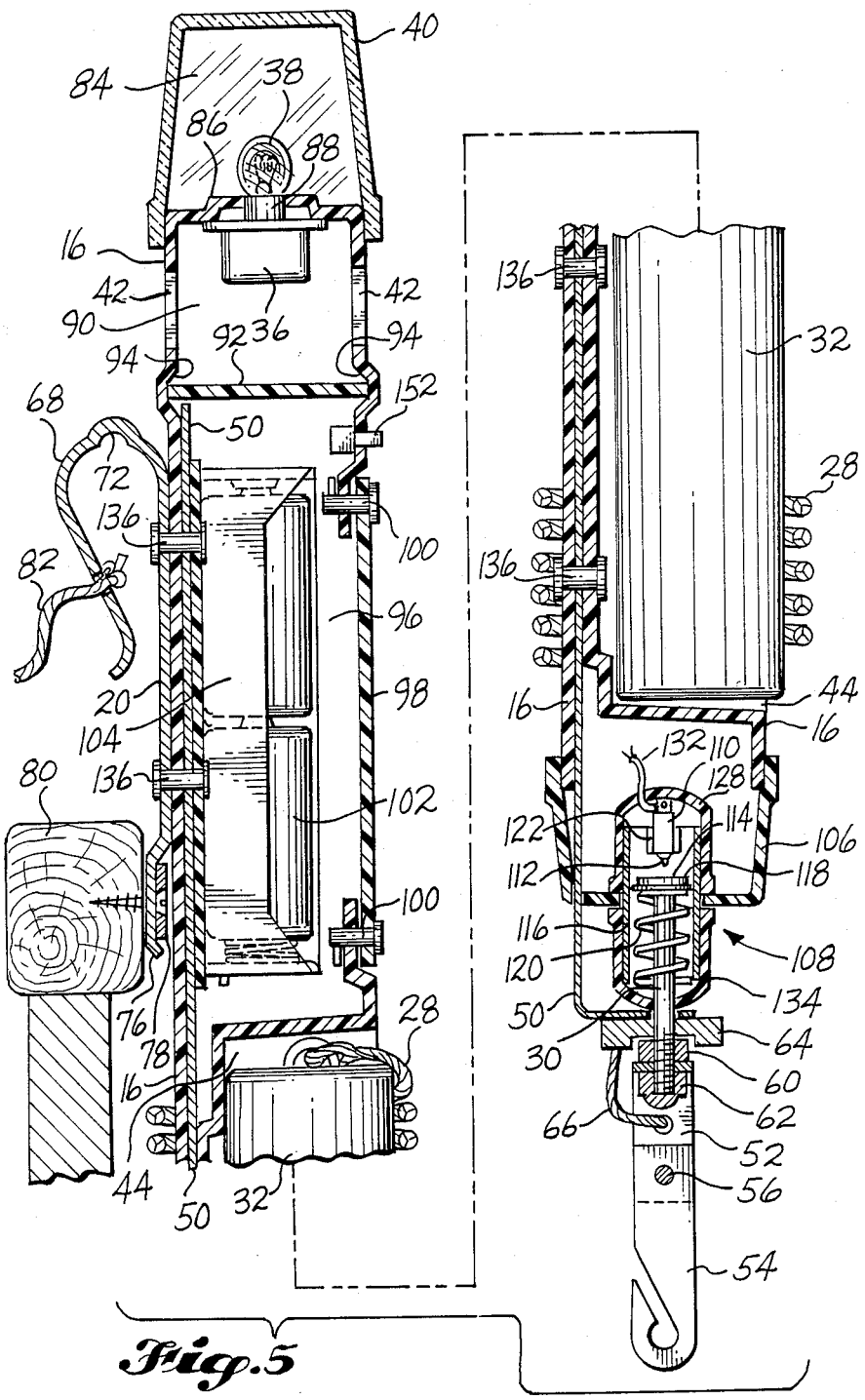
FIG. 5 is a longitudinal-sectional view taken substantially along line 5—5 of FIG. 3, with some parts in side elevation showing the embodiments of FIGS. 3 and 4 attached by a tongue and socket to a wooden boat rail.
Figure 14:
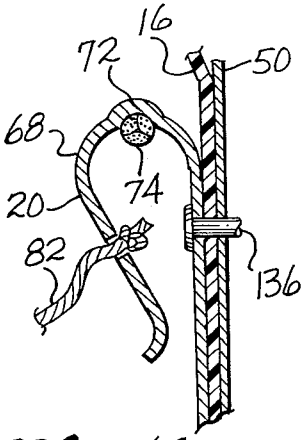
FIG. 14 is a fragmentary cross-sectional view showing the attaching clip in place over a rope lifeline.

FIG. 4 illustrates additional features of the invention. Attached to the main housing 16 is a multi-functional mounting clip 20. The upper bend of the clip 20 is formed with a rounded hook region 68 which may be springingly fitted over a tubular side rail 70 of a boat 12 to provide attachment of the main housing 16 to the boat 12. Attachment in this manner is illustrated in FIGS. 1 and 2. A lifeline retaining portion 72 of the clip 20 is formed in the upper bend thereof. Attachment of the clip 20 over a lifeline 74 is illustrated in FIG. 14. A tongue member 76 may be formed integrally with the clip 20. The main housing 16 may be attached to a boat 12 by inserting the tongue member 76 into a socket 78. The socket 78 may be attached to the hull, the cabin, or a wood rail 80 of the boat 12. Such an attachment is illustrated in FIG. 5. Mounting of the detector 10 is not limited to the exterior or rail of the boat 12. The detector 10 may be located within the cabin or below the deck of the boat 12. In such use, the line 28 could be extended upwardly or outwardly and over a guide, then down into the water 14 beneath the boat 12. A safety laniard 82 may also be attached to the clip 20 to provide a back-up means for securing the detector 10 to the boat 12.

The cross-sectional view shown in FIG. 5 illustrates additional aspects of the invention not readily visible from a plan view. At the uppermost end of the illustrated preferred embodiment of the invention is a signal lamp cavity 84. The signal lamp cavity 84 is defined by the transparent lens cap 40 and an upper end wall portion 86 of the main housing 16. The lens cap 40 is attached to the main housing 16 by a pair of screws 87. Protruding through the upper end wall 86 is the light 38 which is mounted in a lamp socket 88. Immediately below the lamp cavity 84 is a sounding device cavity 90. The sounding device cavity 90 is defined by the walls of the main housing 16, the upper end wall 86, and an internal partition 92. The plurality of openings 42 are formed in the main housing 16 to allow the sound emitted by the buzzer 36 to pass from the sounding cavity 90 to the outside. The internal partition 92 is received in an annular indenture region 94 of the main housing 16 and captured therein.

Figure 8:
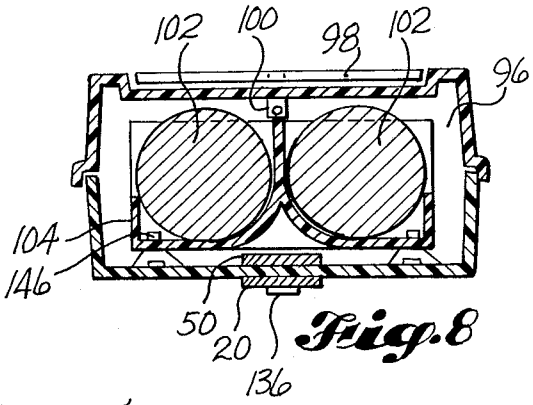
FIG. 8 is a cross sectional view taken substantially along line 8—8 of FIG. 4.

Below the sounding cavity 90 is a power pack cavity 96. The power pack cavity 96 is defined by the main housing body 16, the internal partition 92 and an access door 98. The access door 98 is secured to the main housing 16 by a pair of pivotal latches 100. The access door 98 provides entrance into the power pack cavity 96 for servicing of the power pack held within. In this preferred embodiment the power pack is a plurality of dry cell batteries 102 which are retained within a battery pack 104. Illustrated in this embodiment are four standard "D" size dry cell batteries. It is to be understood that nickle cadmium or another type of rechargeable battery unit may be used. FIG. 8 shows the placement of the batteries 100 and battery pack 104 within the power pack cavity 96 of the main housing 16.

Also formed within the main housing 16 is the weight cavity 44. The weight cavity 44 is shaped to receive the weight 32. In this embodiment, the weight cavity 44 is a recess formed with sidewalls 103, a bottom 105, and access through the front only of the main housing 16. See FIG. 11. Any design which would allow the weight 32 to be stowed within the main housing 16 may be used. A housing base cap 106 closes the bottom of the main housing 16 (see FIG. 10).

Figure 7:
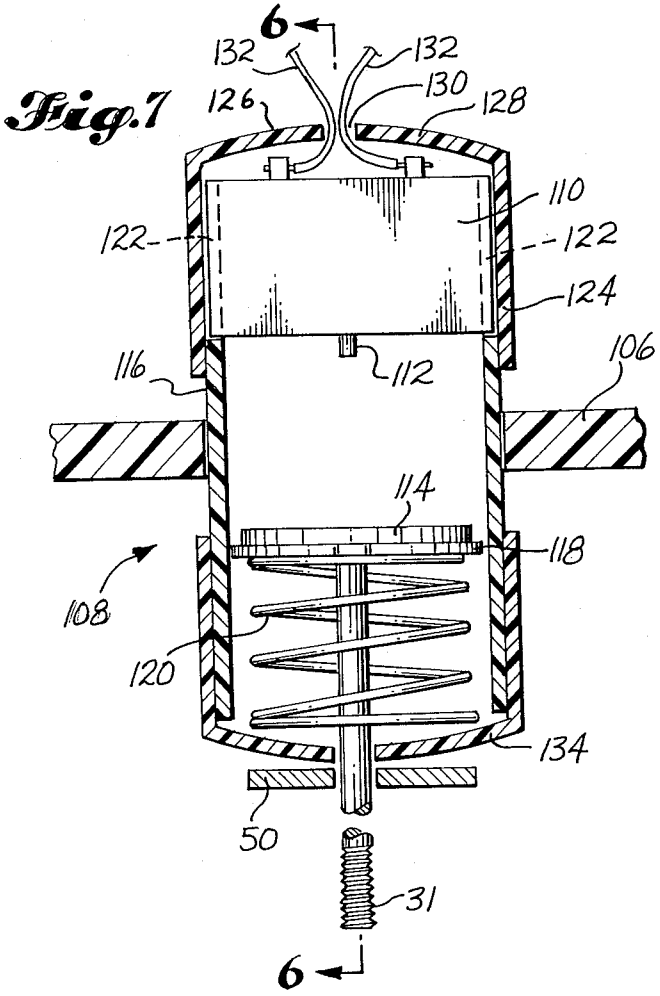
FIG. 7 is a view like FIG. 6 rotated ninety degrees in orientation, and taken about line 7—7 of FIG. 6, and showing the microswitch in side elevation in an open position.
Figure 6:
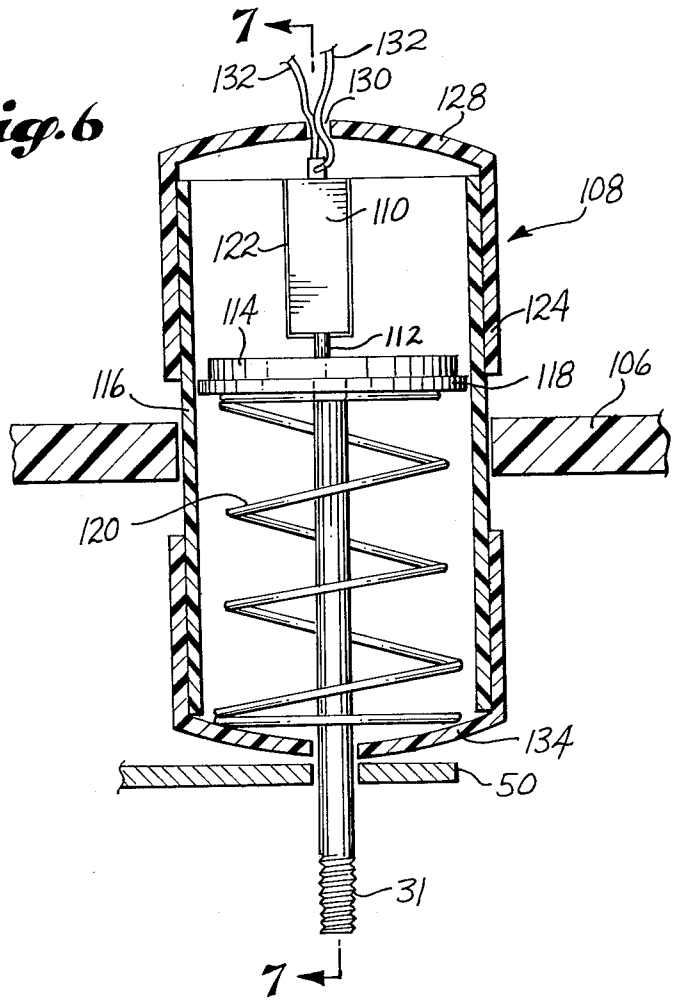
FIG. 6 is an enlarged scale, fragmentary, longitudinal-sectional view of the microswitch assembly within a tubular guide at the lower end of the main housing, taken along line 6—6 of FIG. 7 and showing the microswitch in end elevation in a closed position.

Mounted through the housing base cap 106 is the actuating switch assembly 108. The actuating switch assembly 108 is illustrated in cross section in FIGS. 5, 6 and 7. A snap-action microswitch 110 is mounted within the actuating switch assembly 108 with its depressible operator 112 positioned to be contacted by the flattened end portion 114 of the actuating member 30. Miniature switches of this type having housing dimentions of approximately 0.75 inches×0.25 inches×0.37 inches are well-known in the art and commonly available. The flattened end portion 114 of the actuator member 30 is sized smaller than the internal diameter of the guide tube 116. A guide washer 118 is placed over the actuating member 30 to provide a centered slidable reciprocation of the actuator member 30 within the guide tube 116. A coil spring 120 is located within the guide tube 116 to pressingly bias the actuating member 30 into depressing contact with the depressible operator 112 of the microswitch 110. The tension of the spring 120 must be such that it can be overcome by the pull of the freely hanging weight 32. Although a coil spring is used in the preferred embodiment, any spring-biasing means may be used which serves the same function.

A pair of diametrically opposed slots 122 are formed at the upper end of the guide tube 116. The slots 122 receive and support the housing of the microswitch 110. The microswitch 110 is captured within the slots 122 by the sidewalls 124 and end wall 126 of the upper end cap 128 of the actuating switch assembly 108. An opening 130 is formed in the upper end cap 128 to provide access for wiring 132 to the microswitch 110. The coil spring 120 is retained within the actuating switch assembly 108 by a lower end cap 134 which is fitted over the lower end of the guide tube 116. An opening is formed in the lower end cap 134 to provide a passage for an extension of the actuator member 30 to the outside of the actuating switch assembly 108.

In immediate supporting contact with the actuating switch assembly 108 is the rigid support member 50. A hole is formed in the support member 50 through which the actuator member 30 passes. Placement of the rigid support member 50 is illustrated in FIG. 5. Therein the rigid support member 50 is shown extending along the length of and within the main housing 16 where it is attached by a plurality of rivets 136 which pass through the main housing 16 and the rigid support member 50. Also directly attached thereto is the mounting clip 20 shown mounted directly by rivets to the main housing 16 and the rigid support member 50. The rigid support member 50 protrudes through the lower end cap 106 of the main housing 16 where it then passes laterally across the bottom of the main housing 16 adjacent to the actuating switch assembly 108. By this construction, the downward pull of the free hanging weight 32 is transferred through the line 28 to the actuating member 30 which compresses the coil spring 120 transferring the load to the adjacent supporting member 50 and, in turn, to the attachment clip 20 or tongue member 76 which is attached to the boat 12. The rigid support member 50 and the attachment clip 20 are preferably constructed of a durable metallic material such as stainless steel or other noncorrosive metal. The illustrated embodiment is not exclusive and the function of the support member 50 would be equivalent if it were mounted exterior of the main housing 16 or if constructed integrally with the attachment clip 20 or tongue member 76.

Figure 9:
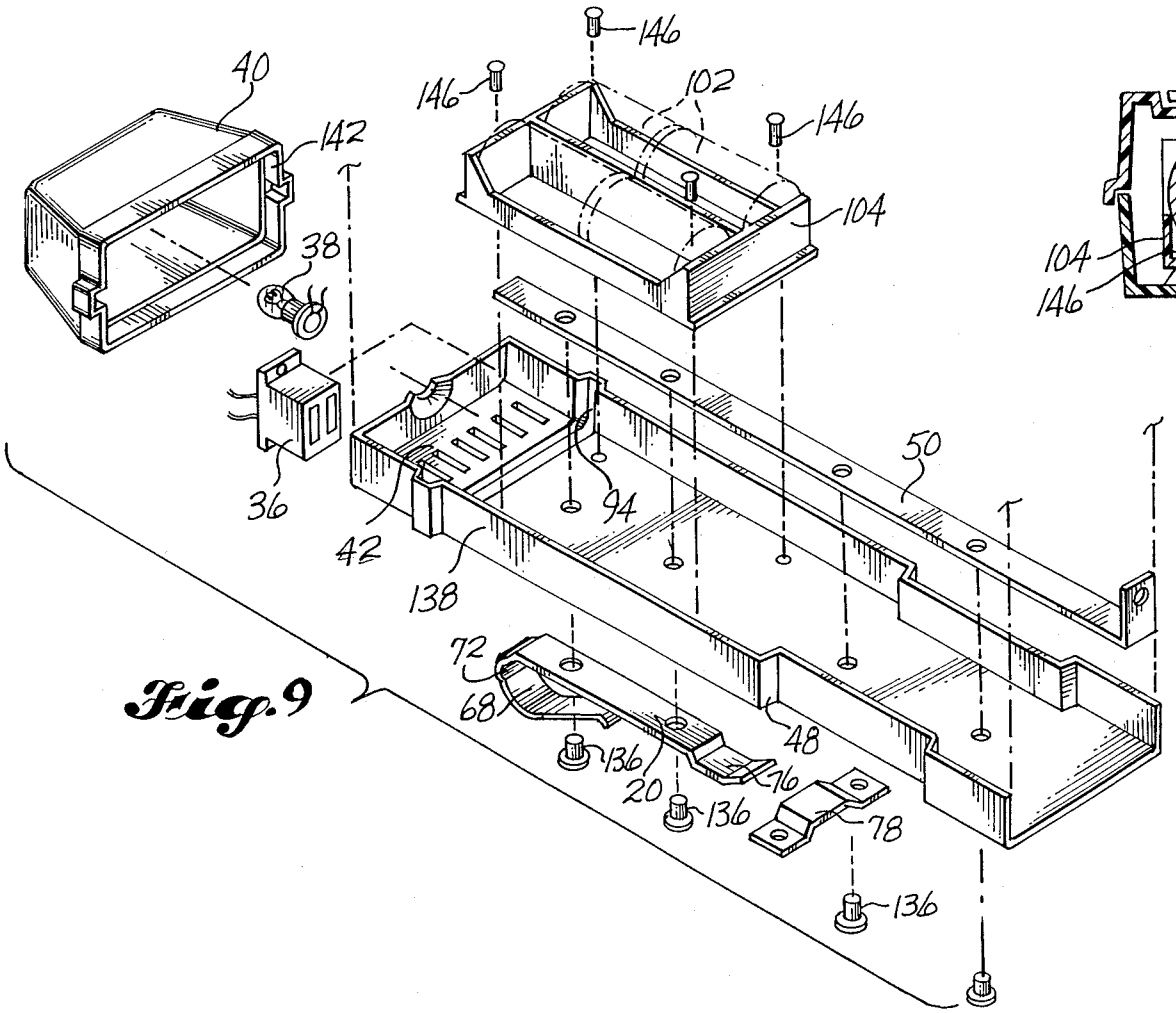
FIGS. 9 and 10 are an exploded pictorial view of the illustrated embodiment of the invention.
Figure 10:
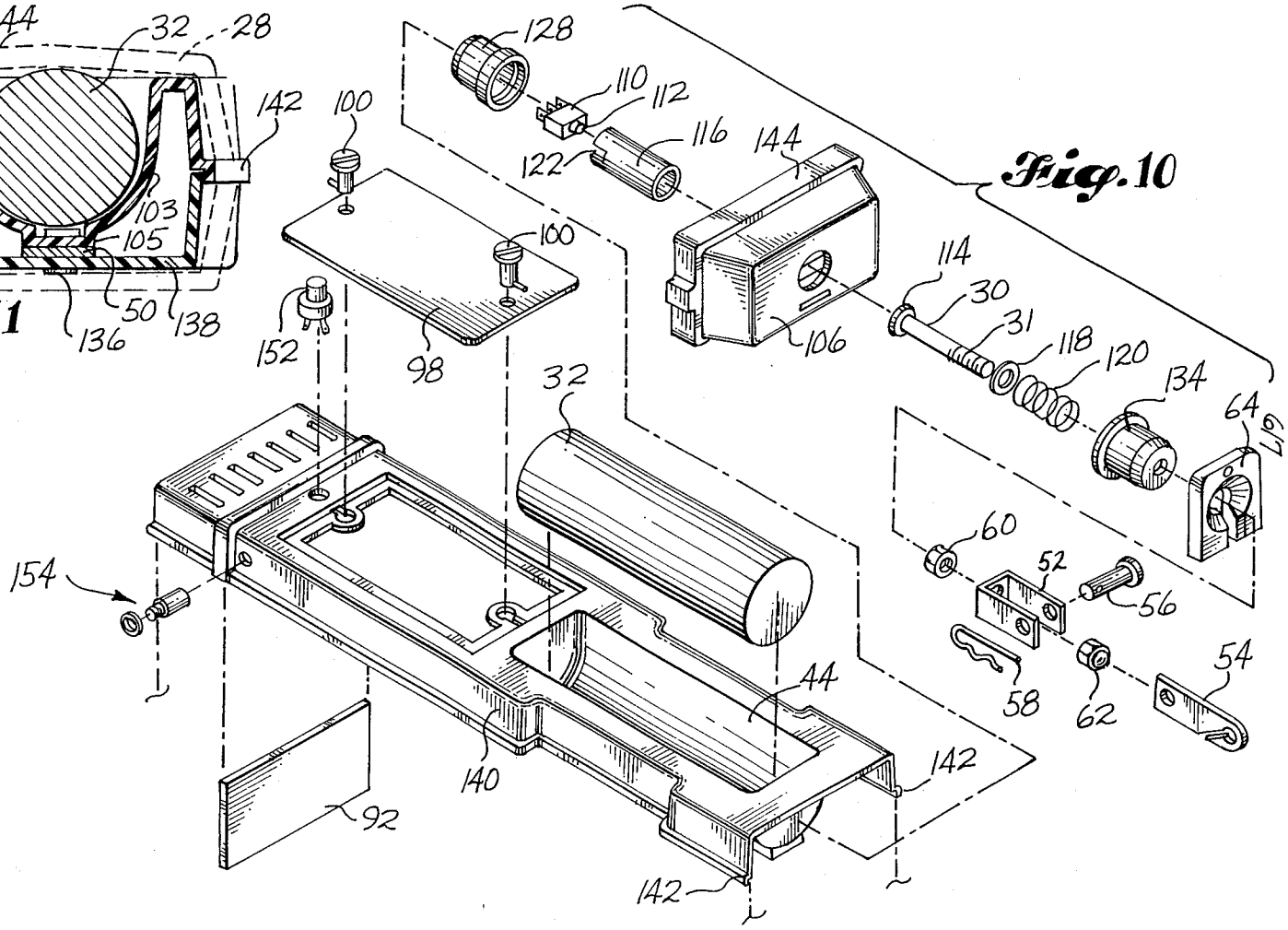
Figure 11:
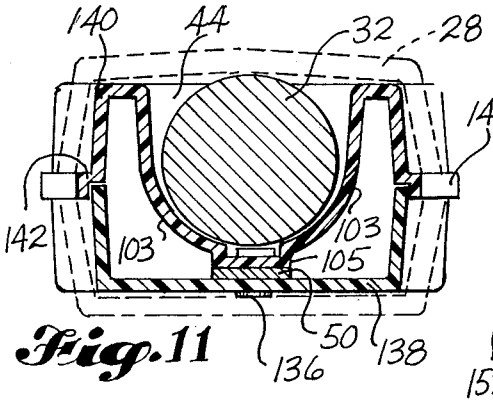
FIG. 11 is a cross-sectional view taken substantially along line 11—11 of FIG. 3.

FIGS. 9 and 10 illustrate the assembly of the components of a preferred embodiment of the invention. The main housing 16 is shown to be assembled from a back housing part 138 and a front housing part 140. In this embodiment the front housing part 140 is formed having an enlarged lip 142 to provide additional strength to the main housing 16 and to provide an increased surface area for attaching the housing back part 138 with the housing front part 140. The lens cap 40 is attached by two screws 87 and is provided with an extended lip 142. The base cap 106 is provided with a lip 144 for similar attachment to the upper and lower ends, respectively, of the main housing assembly 16. As shown in FIGS. 8 and 9 the battery pack 104 is attached to the housing back 138 by rivets 146.

Figure 13:
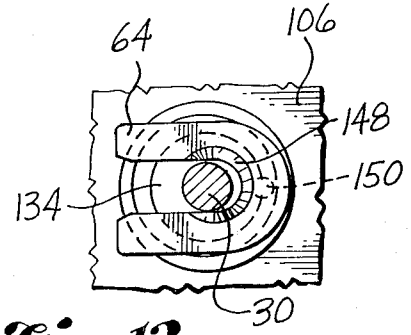
FIG. 13 is a fragmentary end view showing the insert in place on the actuator stem.
Figure 12:
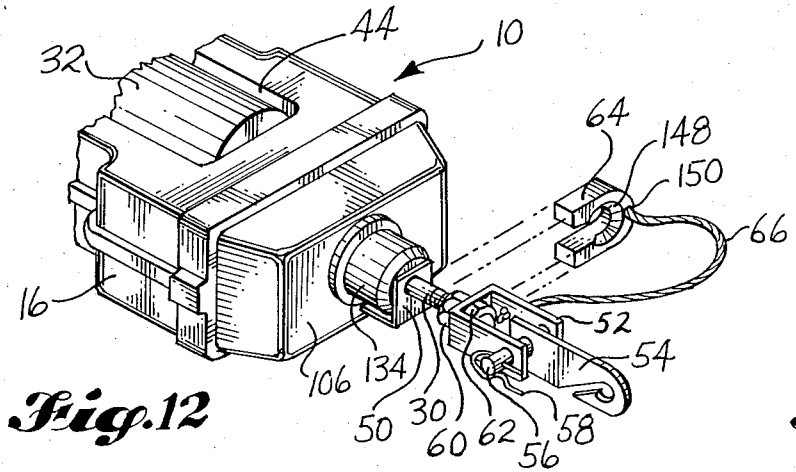
FIG. 12 is a fragmentary pictorial view at the line end of main housings showing a hold-open insert spaced from its use position.

Referring now to FIGS. 12 and 13, therein is shown the placement of the actuator stop member as it may be placed around the actuator member 30. The stop member 64 may be a yoke in the shape of a "U", wherein when fitted between the rigid support member 50 and the upper clevis nut 60 the tension of the spring 120 within the actuating switch assembly 108 holds the stop member 64 in place. The stop member 64 has a thickness great enough to prevent contact of the actuator member 30 with the depressible operator 112 of the microswitch 110. In one side of the actuator stop member 64 may also be formed a counter-sunk recess or indentation 148. This indentation 148 is formed to fit over and engage the upper clevis nut 60 so as to prevent the stop member 64 from inadvertently being displaced from its position over the actuator member 30. If desired, the actuator stop member 64 may also be placed over the actuator member 30 with the recess 148 facing away from the upper clevis nut 60. Insertion in this manner would allow quick release for removal of the actuator stop member 64. The stop member 64 may be secured to the main housing 16 or, as illustrated in FIGS. 3, 4, 5 and 12, to the clevis by means of a retaining laniard 66 secured through an opening 150 in the stop member 64. Such an attachment by a laniard will prevent loss of the stop member 64 when the device 10 is in use.

Figure 15:
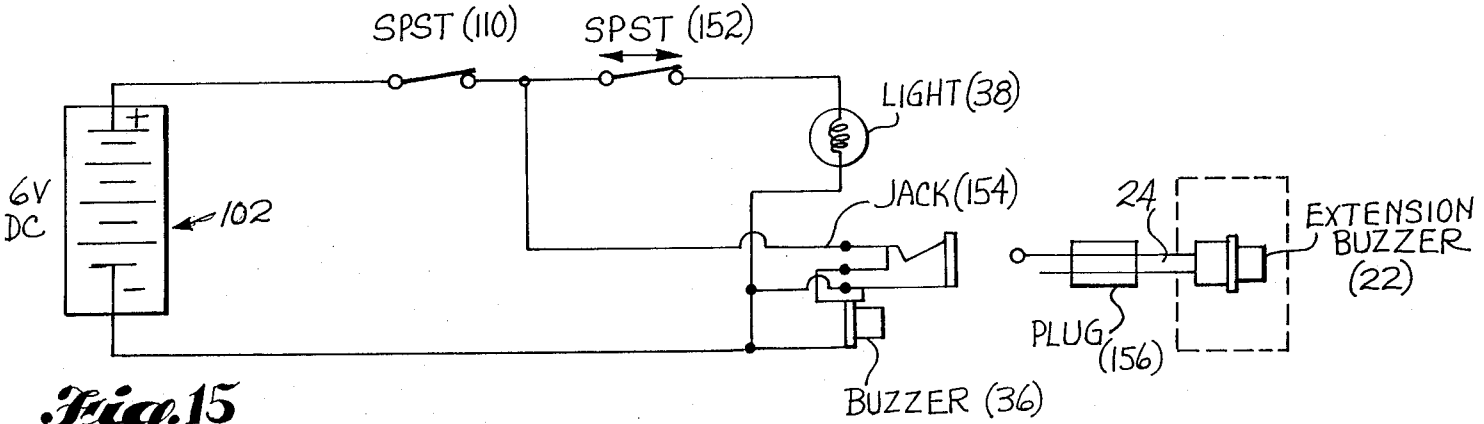
FIG. 15 is a schematic diagram of the electrical circuit of a preferred embodiment of the invention.

FIG. 15 is a schematic diagram of the basic electrical circuit of a preferred embodiment of the detector 10. Therein is shown that when the contacts of the microswitch 110 are closed power is supplied from the battery 106 to the signal light 38 and signal buzzer 36. A second switch 152 or a darkness activated circuit may be provided to disable the light 38 when the detector 10 is being used during daylight hours. A jack 154 may be provided in the circuit and installed in the main housing 16 to provide access for the use of a remote signaling device 22. An extension cable 24 is connected at one end to the remote signaling device 22 and at its other end to a plug 156 which is complimentary to the jack 154.

It is to be understood that other features could be integrated into the basic circuit of the invention without changing the function of the illustrated embodiment. Furthermore, the detector or its main housing could be incorporated into a portion of the boat structure such as the cabin wall or hull. Various embodiments of the invention, including portions of the disclosed embodiment, could be used to adapt the detector 10 to a specific application. The source of electrical energy and/or the signal device may be located remote from the actuating switch assembly. The embodiment which has been described is presented for purposes of illustration and not limitation. I am only to be limited to the wording of the claims which follow, interpreted in accordance with the rules of patent claim interpretation, including the doctrine of equivalents.

What is claimed is:

1. A shallow water detector for a boat, comprising:

a source of electrical energy;

a signal device;

a main housing positionable on a boat;

a normally off snap-action microswitch in said main housing, including a switch housing and a depressible operator projecting outwardly from the switch housing which when depressed turns the switch on;

electrical conductor means connecting the source of electrical energy, the signal device and the microswitch together such that when the microswitch is on the source of electrical energy is connected to the signal device and the signal device is on;

a switch actuator member having an end portion directed towards the depressible operator;

guide means in said main housing for guiding the actuator member for linear reciprocating movement towards and away from said depressible operator;

spring means biasing the actuator member towards and into depressing contact with the depressible operator;

line means for suspending a weight, said line means having a first end connectable to the actuator member and a second end which in use extends from the boat into the water;

a weight connected to the second end of said line means and when suspended exerting a pulling force on the actuator member in opposition to the spring force, and said weight being of sufficient mass when suspended to overcome the force of the spring means and hold the actuator member away from depressing contact with the depressible operator;

said line means being of a predetermined length indicative of a safe depth condition for the boat so long as the weight is suspended; and said spring means functioning in response to bottom contact by said weight of a type and amount sufficient to produce slack in the line means, to move the actuator member into contact with the depressible operator of the microswitch, to depress said operator and operate the microswitch to connect the source of electrical energy to the signal device, causing operation of the signal device to signal a shallow water condition;

wherein said guide means is a tubular housing and said end portion of said switch actuator member is sized to slidably reciprocate within said tubular housing towards and away from the depressible operator.

2. The detector claimed in claim 1 wherein said spring means is a coil spring located within said tubular housing and said coil spring pressingly biases the end portion of the actuator member slidably within the tube towards and into depressing contact with the depressible operator.

3. The detector claimed in claim 1, wherein said line means is a flexible rope and said main housing has narrowed portions, wherein the rope may be stored by wrapping around the narrowed portions of the main housing when the detector is not in use.

4. The detector claimed in claim 1, wherein said source of electrical energy is a battery means within said main housing.

5. The detector claimed in claim 1, wherein said signal device is a sound emitting means and a light.

6. The detector claimed in claim 1 wherein said tubular housing has diametrically opposed slots formed at a first end for receiving and supporting end portions of said switch housing and an end wall at said first end outwardly of the microswitch wherein said microswitch is captured within said tubular housing between said slots and the end wall.

7. The detector claimed in claim 6 wherein said spring means is a coil spring located within said tubular housing and said coil spring pressingly biases the end portion of the actuator member slidably within the tube towards and into depressing contact with the depressible operator, wherein said tubular housing has a second end and a second end wall at said second end, and wherein said actuator member has a portion which extends through the second end wall at the second end of said tubular housing.

8. The detector claimed in claim 1, wherein said main housing has a cavity formed therein for receiving said weight when the detector is not in use.

9. The detector claimed in claim 8, wherein said line means is a flexible rope and said main housing has narrowed portions outwardly spaced from said cavity, wherein the rope may be stored by wrapping around the narrowed portions of the main housing and said weight may be confined in the cavity by the wrapped rope.

10. The detector claimed in claim 1, wherein said tubular housing has upper and lower ends, said actuator member extends through said lower end, and said detector further comprises a rigid support member attached to and extending longitudinally of the main housing and then under said lower end, in supporting contact therewith, said actuator member also extending through an opening formed in said rigid support member, and a means connected to the support member for attaching the main housing to the boat, wherein when the detector is in use, the downward force of the weight is transferred to the boat through the support member and attachment means.

11. The detector claimed in claim 10, wherein the means for attaching the main housing to the boat comprises a tongue attached to said rigid support member and a socket attached to said boat sized to receive and retain said tongue.

12. The detector claimed in claim 10, wherein the means for attaching the main housing to the boat comprises a clip having portions formed to hang over both a rail and a rope on said boat.

13. The detector claimed in claim 1, further comprising means for preventing contact of the actuator member with the depressible operator when the detector is not in use.

14. The detector claimed in claim 13, wherein said contact preventing means is a member insertable between a portion of the actuator member and a portion of the main housing, for holding the actuator member out of depressing contact with the depressible operator.

15. The detector claimed in claim 1, wherein said source of electrical energy is a battery, said signal device is a sound emitting means and a light, said battery, said sound emitting means and said light being located within the main housing, said line means is a flexible rope, said main housing has a cavity formed therein for receiving said weight when the detector is not in use, and said main housing has narrowed portions outwardly spaced from said cavity, wherein the rope may be stored by wrapping around the narrowed portions of the main housing and said weight may be confined in the cavity by the wrapped rope.

16. The detector claimed in claim 15, further comprising a second sound emitting means remote from the main housing and a second electrical conductor means which may connect said second sound emitting means, the battery, and the microswitch such that when the microswitch is on, the second sound emitting means is operated by the battery.

* * * * *